US006539864B1

(12) United States Patent
Berggren

(10) Patent No.: US 6,539,864 B1
(45) Date of Patent: Apr. 1, 2003

(54) HAND STAMP SET

(76) Inventor: Ove Berggren, Aspeliden 6, S-590 55 Linköping (SE)

( * ) Notice: Subject to any disclaimer, the term of this patent is extended or adjusted under 35 U.S.C. 154(b) by 0 days.

(21) Appl. No.: 09/719,192

(22) PCT Filed: Jun. 11, 1999

(86) PCT No.: PCT/SE99/01030

§ 371 (c)(1),
(2), (4) Date: Feb. 14, 2001

(87) PCT Pub. No.: WO99/67096

PCT Pub. Date: Dec. 29, 1999

(30) Foreign Application Priority Data

Jun. 11, 1999 (SE) ..... 9802091

(51) Int. Cl.[7] ..... B41K 1/56
(52) U.S. Cl. ..... 101/405; 101/368
(58) Field of Search ..... 101/405, 406, 101/379, 368, 327; 211/39

(56) References Cited

U.S. PATENT DOCUMENTS

| | | | | | |
|---|---|---|---|---|---|
| 1,880,947 | A | * | 10/1932 | Evans | 211/39 |
| 4,291,622 | A | | 9/1981 | Bengtsson | 101/368 |
| 4,676,162 | A | * | 6/1987 | Phipps et al. | 101/327 |
| 5,261,325 | A | | 11/1993 | Bengtsson | 101/327 |
| 5,377,599 | A | | 1/1995 | Wall et al. | 101/327 |
| 5,765,484 | A | * | 6/1998 | Lam | 101/327 |
| 5,950,535 | A | * | 9/1999 | Faber | 101/105 |
| 6,003,686 | A | * | 12/1999 | Pichler | 211/39 |
| 6,119,596 | A | * | 9/2000 | Fletcher et al. | 101/327 |

FOREIGN PATENT DOCUMENTS

| | | |
|---|---|---|
| DE | 1196673 | 7/1965 |
| DE | 28 48 362 | 5/1979 |
| EP | 507758 | 10/1992 |
| GB | 2277298 | 10/1994 |
| WO | 88/01943 | 3/1988 |

* cited by examiner

*Primary Examiner*—Anthony H. Nguyen
(74) *Attorney, Agent, or Firm*—Banner & Witcoff, Ltd

(57) ABSTRACT

A hand stamp having an improved mechanism for accommodating an angular deviation between a stamp pad and a surface being stamped and a stamp and stamp rack set in which the stamp is easily engageable and disengageable with the stamp rack. A spring mechanism is provided between a stamp pad holder and a surrounding cover. The spring mechanism biases the stamp pad holder into a retracted position within the cover, and also helps to resiliently accommodate any alignment deviation between the stamp pad and the surface being stamped. The stamp rack is formed to easily receive and retain a stamp therein. Also, the stamp rack may include engagement structures whereby a plurality of stamp racks can be easily engaged to each other.

9 Claims, 2 Drawing Sheets

HAND STAMP SET

The present invention relates to a hand stamp set comprising a stamp having a holder for a stamp pad, an ergonomically designed handle that can be applied in different directions, a downward open cover enclosing the holder and having a guiding sleeve extending into the handle and a stamp rack.

Stamps available in the market in many cases has a particular function permitting the pressure of the stamp pad against the bed to be regulated to increase the pressure when the saturation of stamp ink in the stamp pad decreases. Certain solutions show a specific adjustment device that changes the pressure of the stamp pad against the bed by turning a ring underneath the handle. These solutions result in more expensive manufacturing by need of more details and increasing assembling time. Besides an operator has to perform a specific measure by means of both hands to alter the pressure against the bed.

Other solutions like the one disclosed in the application SE 9100994-4 is self-adjusting as the holder of the stamp pad has a separate spring 16, flexible and axially attached to the shaft and thereby the handle. The solution requires many details and particularly the shaft has a complicated shape.

For most hand stamps a protective cover is provided that is put on when the stamp is not in use. When putting it on, it is necessary to use both hands to correctly fit the stamp in the cover and then the fingers may very well get in contact with the stamp pad and the stamp ink on it. Thus, accuracy to a certain extent must be maintained to fit the stamp correctly into the cover. In most cases the cover has a bottom area which is inconsiderably larger than that of the stamp and consequently small stamps easily overturn when unintentionally touched if they are unfixedly kept on a desk. To set this right, carousel-like devices are available in which the stamps can be hanged. Yet the stamps must have a cover, among other things to prevent them from drying up.

An object with the present invention is to achieve an improved hand stamp set that eliminates the above mentioned disadvantages of known designs and that is composed of fewer and simpler parts.

Another object is to achieve a hand stamp set comprising a stamp rack where the stamp can be fit in and removed by using only one hand and that any desired number of stamp racks, provided with an easily readable label or print on the user's side can be connected.

These objects are achieved with a hand stamp set having the characteristics in claim 1 and the subsequent sub-claims.

A preferred working example of the present invention will now be described more closely with reference to the attached drawings, in which.

Figure 1:
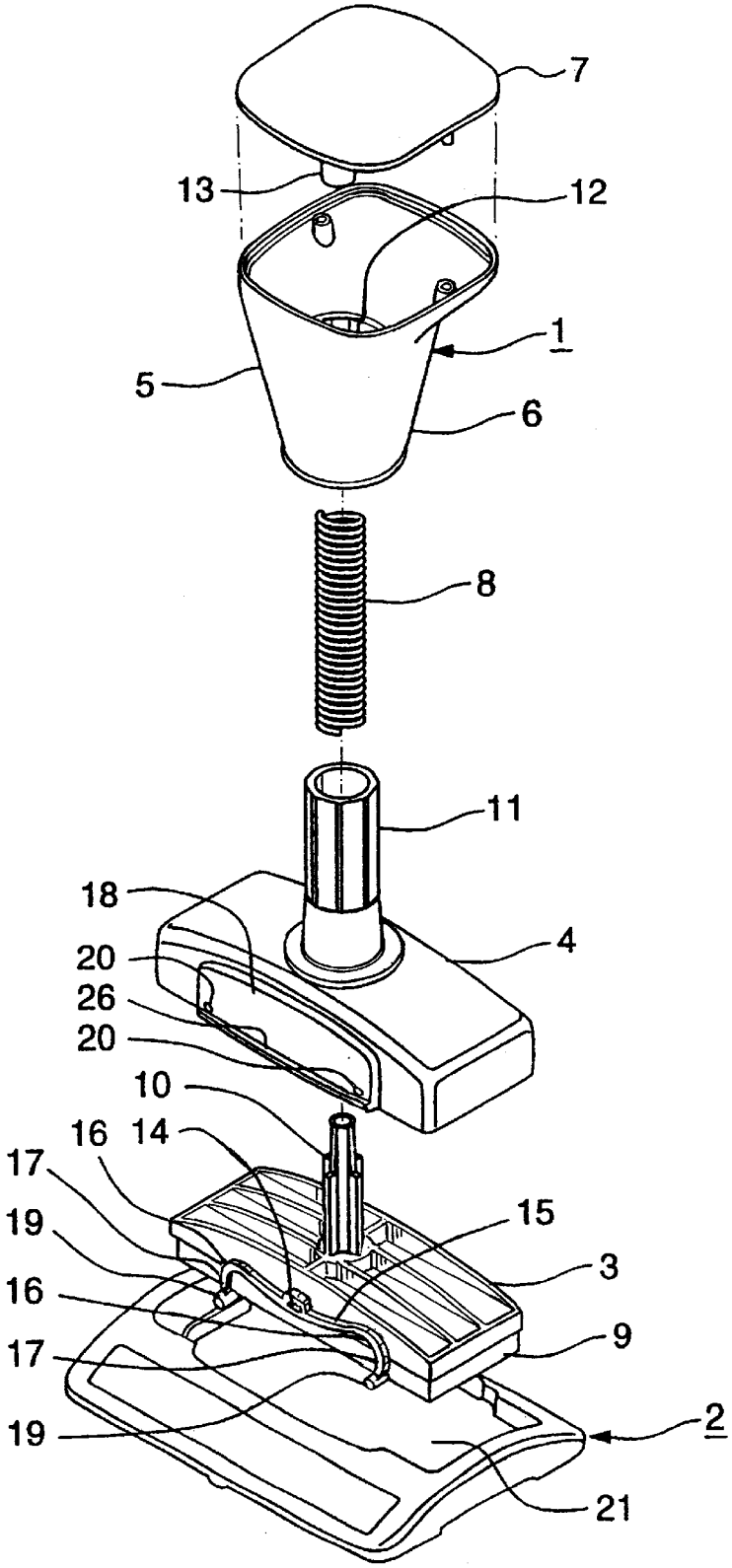
FIG. 1 shows an exploded view of a hand stamp set

FIG. 1 shows a hand stamp set comprising two major parts; a stamp 1 and a stamp rack 2. The stamp comprises a stamp pad holder 3, a cover 4, a handle 5, consisting of a lower part 6 and an upper part 7 and a flexible, compressible element 8 keeping the handle and the stamp pad holder together.

FIG. 1 shows how a stamp pad is mounted (glued or taped) inside the stamp pad holder 3. On its upper side the holder 3 has a first tapered fixing means 10 with a through hole, extending into a first guiding sleeve 11, which extends from the upper side of the cover 4.

The guiding sleeve extends into a second guiding sleeve 12 inside the lower part 6 of the ergonomically shaped handle 5 to guide this in an up and down movement. From the inside of the upper part 7, a second tapered fixing means 13 extends inside the lower part 6 of the handle. The second guiding sleeve 12 inside the lower part 6 of the handle has a section in the shape of a polygon, like the outside of the first guiding sleeve 11, whereby the handle 5 easily can be applied in different directions relative the cover 4.

The flexible and compressible element 8, connecting the stamp pad holder 3 and the handle 5 is made of a coil spring pressed on the tapered fixing means 10 and 13, whereby the taper makes the spring to get a hold on respective fixing means to keep the handle 5 and the stamp pad holder 3 together. With a reasonable force the spring can be pulled off the fixing means 10 when the stamp is to be disassembled or for rotating the handle into a new position.

The flexible and compressible element 8 can as well be a cylinder (not shown), integrated in and extending downward from the inside of the upper part 7 of the handle and having a number of alternating radial slots to achieve flexibility and spring action.

Besides keeping the handle and the stamp pad holder together, the function of the element 8 is to even the pressure an operator applies on the stamp at stamping.

The stamp pad holder 3 has taps 14 with rectangular cross section projecting from the middle of the long side, distanced from its lower edge. On the taps, parallel to respective plane of the long sides, spring means 15 are applied. The spring means have an opening in the centre, admitting mounting on the projecting taps 14 on the stamp pad holder 3. The spring means have a M-like shape with the legs of the spring having a cross section that decreases from the centre part to a constant cross section proceeding via radii 16 into downward directed legs 17, so that a maximum spring action is achieved and that the maximum flexural resistance is located near the opening in the middle. The spring means are located inside a projecting part 18 on each long side of the cover 4.

The legs 17 are provided with outward directed taps 19 to be snapped into circular openings 20 in each lower comer of the projecting parts 18. The spring action of the legs will hereby keep the stamp pad holder and the stamp pad inside the cover in an initial position for stamping. Due to the long acting length of the spring legs, a practically constant spring action is achieved at stamping. The spring means also allow the stamp pad to hit the bed with equal pressure all over the area even if the cover at stamping gets into a slanting position due to some obstacle, for instance a paper clip, staples or the like.

Figure 2:
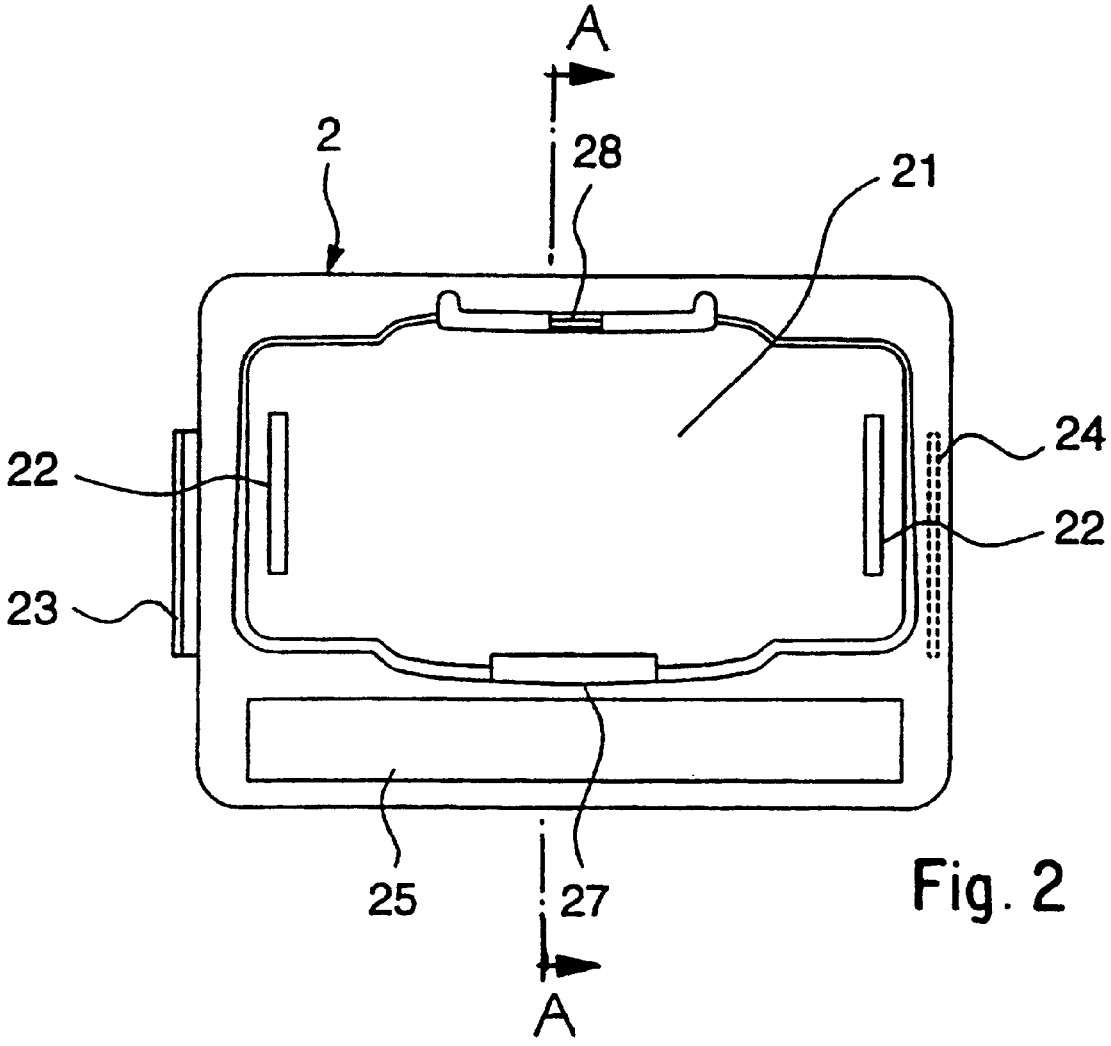
FIG. 2 shows a plane view of a stamp rack
Figure 3:
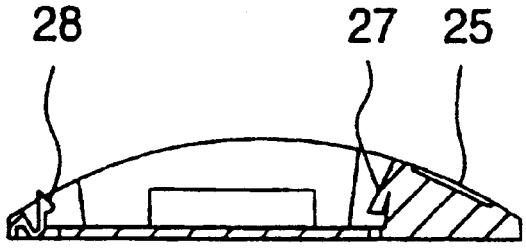
FIG. 3 shows a cross-section A—A through a stamp rack.

The stamp rack 2, showed in a plane view in FIG. 2 and in a cross-section in FIG. 3, has a depressed part 21, into which the stamp is put at parking. The part has a bottom surface with the same shape as the outside contour of the cover. The part has outward inclined walls giving it a funnel shape, which facilitates parking of the stamp. On the bottom of the rack there are supports 22 at each short side catching the stamp pad holder and prevent unintentional stamping on the bottom of the rack. Along its one short side, the stamp rack has a projecting and upward directed hook 23 and on the opposite short side a corresponding cavity 24, in which a hook from an adjacent stamp rack can be hooked. Hereby more stamp racks can be hooked together and keep the stamps on a working place in order. The stamp rack has an inclined surface 25, directed towards the user, onto which a label or print can be applied.

From FIG. 1 it can be seen that the cover 4, on each side, along the lower edge of the projecting part 18, has longitudinal, narrow flanges 26. At parking the stamp is slightly tilted towards the user and put down into the rack along the edge directed towards the user, whereby an inclined, guiding plane 27, beginning at the upper edge of the rack, lets the cover flange directed toward the user slide downward-forward, along the plane until it slides in under the plane. The stamp is then brought into an upright Position so that a resilient tongue 28 engages the flange on the opposite long side of the cover. The stamp can easily be removed from the stamp rack by the user tilting the stamp toward himself, whereby the flange on the opposite long side of the cover disengage the tongue 28, whereupon the stamp is moved forward-upward, out of the stamp rack.

The described parking/removing procedure is easily performed with one hand and needs minor attention to fit the stamp into the stamp rack, since the stamp initially is guided into the right position by the flange directed toward the user slides along the plane 27 and is guided into the recess for the flange in the rear of the stamp rack. The inclined sides contribute to facilitate putting the stamp into the stamp rack.

The hand stamp set can within the scope of the appended claims be given different shapes, for instance by that the spring means begin at locations in the ends of the holder and extend towards the centre of the long sides of the holder.

What is claimed is:

1. A hand stamp comprising:

a stamp pad holder;

a cover for said stamp pad holder, said cover having an open side from which said stamp pad holder is selectively exposed; and a handle connected to said stamp pad holder through an opening formed in said cover, said handle and said stamp pad holder being movable relative to said cover; and a M-shaped spring mechanism mounted on said stamp pad holder, a central portion of said spring mechanism being mounted on said stamp cover and respective distal end portions of said spring mechanism being connected to an interior of said cover, said spring mechanism being arranged so as to bias said stamp pad holder towards a retracted position relative to said cover, and to resiliently accommodate an angular deviation between said stamp pad holder and a surface being stamped.

2. The hand stamp according to claim 1, further comprising leg portions, wherein said leg portions of said spring mechanism extending from said central portion initially decrease in cross section then have a constant cross section and respective peak portions of said M-shaped spring mechanism are rounded so as to locate a maximum flexural resistance of said spring mechanism at said central portion.

3. The hand stamp according to claim 1, wherein said handle and said stamp pad holder are connected by an elongate, axially resilient member extending through said cover.

4. The hand stamp according to claim 3, wherein said axially resilient member is a coil spring.

5. The hand stamp according to claim 3, wherein said axially resilient member is constructed and arranged to even a force applied by a user during stamping.

6. A hand stamp set, comprising:

a stamp pad holder;

a hand stamp including a cover for covering said stamp pad holder, the cover including laterally extending and upwardly turned flange portions on opposite sides of said cover; and a hand stamp rack having a space for receiving a portion of said hand stamp therein, a periphery of said space generally corresponding to a peripheral contour of said hand stamp, wherein an angled guide surface is provided on one side of said space and a resilient latching tongue is provided on the opposite side of said space, in correspondence with said flange portions located on said cover, said flange portions being selectively engageable with an edge of said guide surface and said latching tongue respectively so as to retain said hand stamp in place relative said stamp rack.

7. The set according to claim 6, wherein said hand stamp comprises:

said stamp pad holder;

said cover for said stamp pad holder, said cover having an open side from which said stamp pad holder is selectively exposed; and a handle connected to said stamp pad holder through an opening formed in said cover, said handle and said stamp pad holder being movable relative to said cover; and a spring mechanism mounted on said stamp pad holder and connected to an interior of said cover, said spring mechanism being arranged so as to bias said stamp pad holder towards a retracted position relative to said cover, and to resiliently accommodate an angular deviation between said stamp pad holder and a surface being stamped.

8. The set according to claim 6, wherein a first edge of said stamp rack includes a recess formed therein and a second edge of said stamp rack opposite said first edge includes a hook formed therein, wherein said hook of said stamp rack is engageable with a recess of another said stamp rack.

9. The set according to claim 6, wherein an exterior surface of said stamp rack includes an area for an stamp-identifying label.

* * * * *